US007823725B1

(12) United States Patent
Shupe

(10) Patent No.: US 7,823,725 B1
(45) Date of Patent: Nov. 2, 2010

(54) SHIPPING AND DISPLAY PALLET ASSEMBLY

(75) Inventor: Vaden S. Shupe, Johnson City, TN (US)

(73) Assignee: Triad Packaging, Inc., Bristol, TN (US)

( * ) Notice: Subject to any disclaimer, the term of this patent is extended or adjusted under 35 U.S.C. 154(b) by 66 days.

(21) Appl. No.: 12/011,096

(22) Filed: Jan. 24, 2008

(51) Int. Cl.
*B65D 19/00* (2006.01)

(52) U.S. Cl. ..... 206/386; 206/509; 206/561; 229/915

(58) Field of Classification Search ..... 206/386, 206/503–504, 511–512, 595–600, 509, 784, 206/45.29, 45.25, 564, 561; 229/120.33, 229/120.36, 199, 915; 211/133.1, 191, 194; 108/51.3

See application file for complete search history.

(56) References Cited

U.S. PATENT DOCUMENTS

| | | | | |
|---|---|---|---|---|
| 3,199,764 | A * | 8/1965 | Oliver et al. | 206/599 |
| 3,456,602 | A * | 7/1969 | Davidson | 108/51.3 |
| 4,169,417 | A * | 10/1979 | Gemvik | 108/56.3 |
| 4,895,250 | A * | 1/1990 | Schifrin | 206/223 |
| 5,429,236 | A * | 7/1995 | Evans | 206/386 |
| 6,227,370 | B1 * | 5/2001 | Earnshaw et al. | 206/497 |
| 6,267,255 | B1 * | 7/2001 | Brush | 211/59.4 |
| 6,530,476 | B1 * | 3/2003 | Overholt | 206/386 |
| 7,281,648 | B2 * | 10/2007 | Lowry | 229/199 |
| 7,467,714 | B2 * | 12/2008 | Slat et al. | 206/509 |
| 2003/0000432 | A1 * | 1/2003 | Crevillen Pastor | 108/51.3 |
| 2003/0038051 | A1 * | 2/2003 | Bennett et al. | 206/509 |

* cited by examiner

*Primary Examiner*—Ehud Gartenberg
*Assistant Examiner*—Robert Poon

(57) ABSTRACT

A lightweight shipping and display assembly of corrugated board for containing packages of frangible food items, the assembly having a vertical axis and comprising an upright stack of pallets each having a horizontal floor spaced vertically from an adjacent upper pallet by spacer means comprising a plurality of interconnected arms generally horizontally arrayed and having upper and lower edges, wherein the lower edges rest on the floor, wherein the upper edges are formed with upper adjacent floor contact portions and vertically extended lock tabs, wherein the tabs have been inserted thru slots in an adjacent upper floor to provide a first stop means, wherein a raised rim means surrounds the periphery of the floor and provides on its inner surface shoulder means adapted to engage end portions of the support arms to provide second stop means, said first and second stop means preventing independent individual rotation of any structures of said assembly about the vertical axis, and wherein the support arms extend radially outward from the vertical axis in a laterally spaced generally wedge shaped pattern to provide open front item storage and display alcove areas which are readily viewable around the assembly.

9 Claims, 5 Drawing Sheets

22
42
52
56
58
60
61
62
63
64
65
66
67
68
70
63 1/16
48 9/16
48 3/16
40 3/16
55 1/16
40 15/16
3 1/4
3 7/16
3 3/8
7 3/4
62(a)
63(a)

SHIPPING AND DISPLAY PALLET ASSEMBLY

BACKGROUND OF INVENTION

1. Field

This invention is in the field of shipping (and display) containers for food and other lightweight items, particularly for relatively inexpensive bags of frangible foods such as Tostitos®, potato chips and the like, wherein container weight must be minimized for many reasons including shipping and handling cost while providing protection against breakage and crushing of the items during transportation, diaplay and handling, e.g., by forklift trucks.

2. Prior Art

Heretofore the shipping and display containers for such food items having utilized fairly heavy materials, including wood sections, an unwieldly number of parts and excessive assembly time and effort, and further have not been entirely satisfactory from the standpoint of container strength, cost of container manufacture, customer appeal, free standing stability, ease of handling, special dimensional adaptation for enhanced transport efficiency, environmental considerations such as container reuseability, container construction material recycleability, or the like, and in particular, where corrugated board is used for the construction, the prior containers have failed to provide adequate resistance to deformation in general, and particularly to twisting deformation of the containers caused, for example, by jostling of the loaded containers by forklift trucks and the like.

SUMMARY OF THE INVENTION

A pallet type of shipping and display assembly for frangible, lightweight items such as packaged food or the like comprising an upright stack of pallets having a vertical axis, each pallet having a floor formed with a peripheral upstanding rim means having shoulder means on its inner surface, each said pallet further having a spacer means nested on said floor within the confines of said rim means and having a radially extending array of spacer arms with end portions engaging said shoulder means to prevent angular movement about said axis between said floor and said spacer means, locking tabs on upper edge portions of said spacer means and inserted thru slot means in an adjacent floor of an upper pallet to prevent angular movement about said axis between said spacer means and said adjacent floor, whereby the combination of said tabs, slot means, arm end portions and rim means provides a pallet assembly having exceptionally large resistance to twisting deformation, wherein said spacer means has a sufficient height to space said pallets vertically sufficiently to contain packages of said items on the pallet floors and to display said items to the viewing public, and wherein each spacer means and an upper floor attached thereto are readily disassembled from the stack by lifting said spacer means out of the associated rim means.

BRIEF DESCRIPTION OF THE DRAWINGS

The invention will be understood further from the drawings herein and their description wherein the figures are not to scale or consistent portions or dimensions, and wherein.

DETAILED DESCRIPTION

Figure 1:
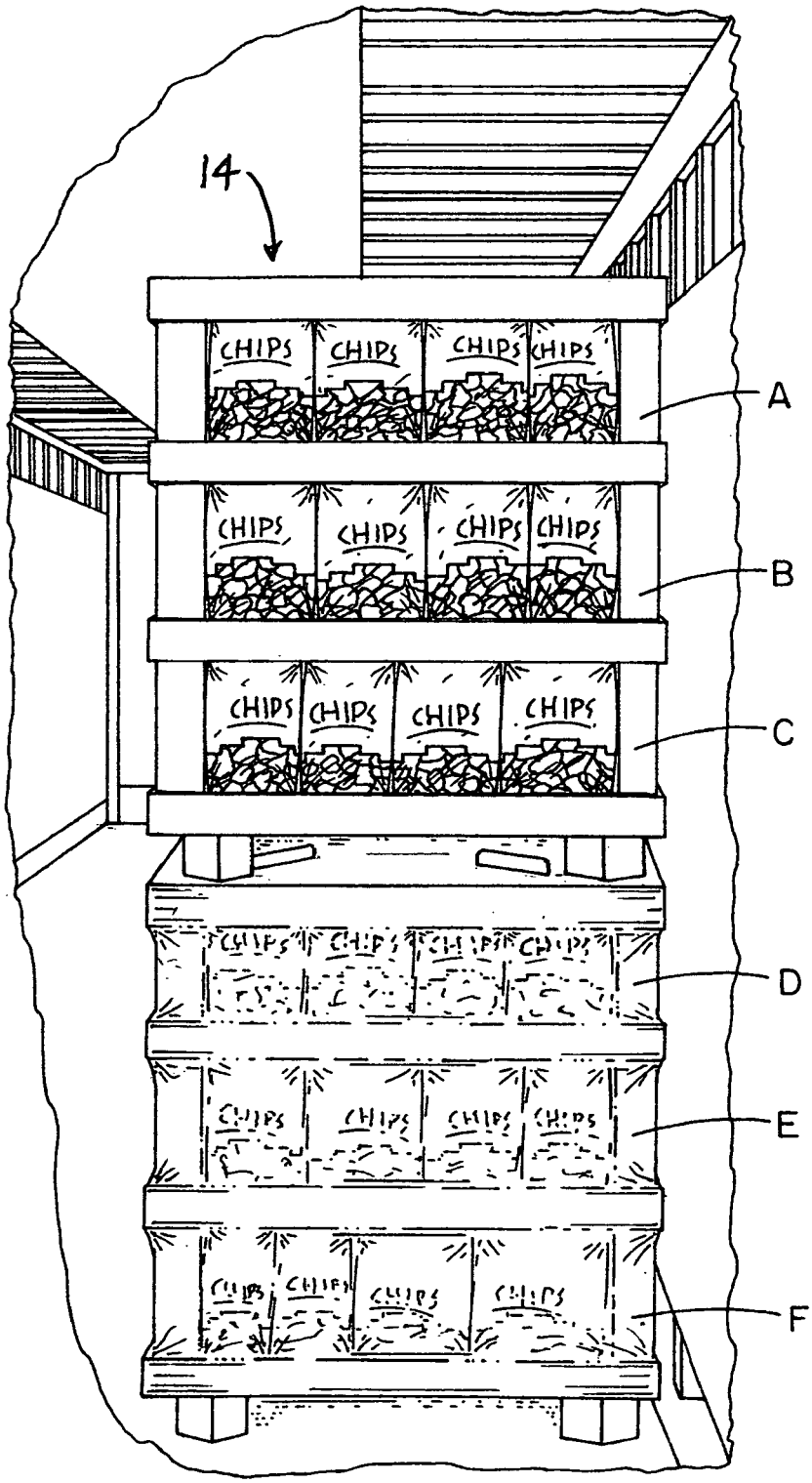
FIG. 1 is a free standing double stacked pallet structure containing food item bags and wherein the lower stack is wrapped in clear plastic sheet which aids in protecting and holding the bags in place during shipment.

Referring to the drawings and with particular reference to the claims herein, the present pallet assembly 14 having a vertical axis 16, comprises an upright stack of pallets A-F each of which has a longitudinal plane 18 and a lateral plane 20, a floor 22 bordered by an upstanding rim 23, and a spacer means generally designated 24 which spaces and supports each floor generally vertically from other floors. Each said spacer means comprising a plurality of interconnected vertical spacer arms such as 26, 28, 30, 32 having upper 34 and lower 36 edges, wherein said upper edges are formed with floor contact portions 38 and vertically extended lock tabs 40. Any number of such spacer arms can be employed depending on the size, weight and shape of the items to be contained in the assembly. The tabs 40 are shown to have been slidably inserted thru slots 42 in the floors to prevent independent individual rotation of any of the floors about the vertical axis. The support arms extend radially outward from said vertical axis in a laterally spaced generally wedge shaped pattern to provide open front item 45 storage and display alcove areas such as 44, 46, 48, 50 which are readily viewable around said pallet assembly.

The pallet stack such as A, B, C can be varied in number, e.g., 2-10 pallets since the present individual pallet construction can readily be manufactured to a weight of about 3.5 lbs. or less to provide a pallet stack which can support weights of 2 to 3 hundred pounds or more of food items employing a commercial grade and weight of corrugated board.

Figures 2, 2A:
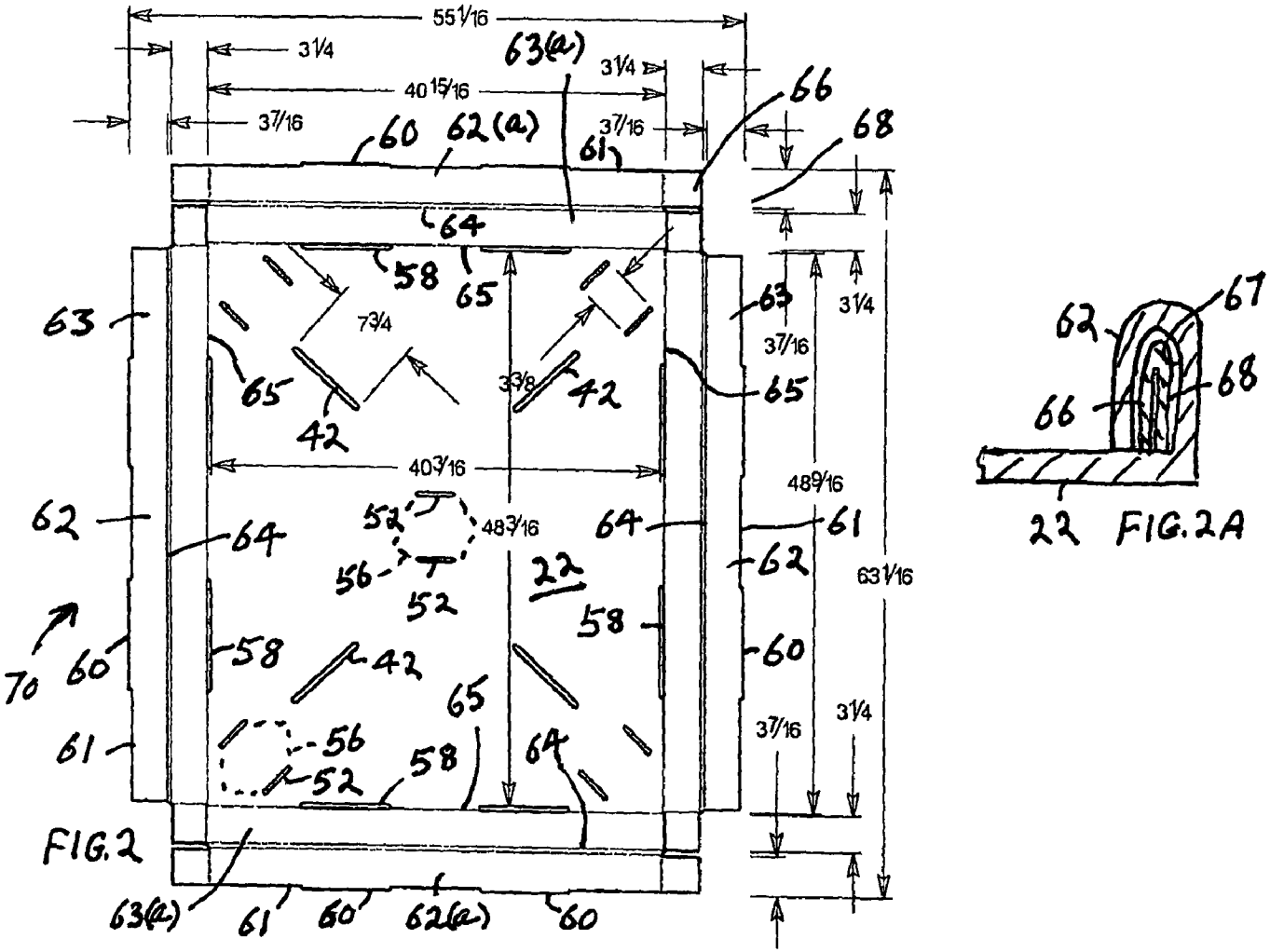
FIG. 2 is a plan view of a floor blank of corrugated board with dimension examples.
FIG. 2A is a cross-section taken along line 2A-2A in FIG. 5.
Figure 8:
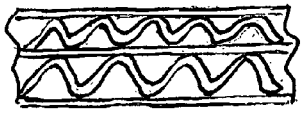
FIG. 8 is an enlarged cross-section of a typical corrugated board, preferably of recycled paper, which can be used for the present spacer means.
Figure 8A:
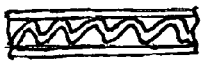
FIG. 8A is an enlarged cross-section of a typical corrugated board, also preferably of recycled paper, which can be used for the present floors and foot members.
Figure 7:
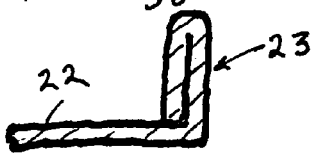
FIG. 7 is a cross-section taken along line 7-7 in FIG. 5.

The floors 22 are preferably made from corrugated board blanks such as shown in FIGS. 2 and 8A wherein is shown the various tab receiving slots 42 for tabs 40 on the spacer arms, slots 52 for tabs 54 on foot members 56, and slots 58 for tabs 60 on the folded in edges 61 of peripheral longitudinal rim sections 62 and lateral sections 62(*a*). These sections are folded along lines 64 and 65 whereby tabs 60 can be inserted (locked) into slots 58. In the embodiment shown, end portions 66 and 68 of rim sections 62(*a*) and 63(*a*) can be bent double and inserted into cavity 67 formed by bending sections 62 and 63 inwardly as shown in FIG. 2A. When these sections 62 and 62(*a*) are locked into slots 58 in the floor the peripheral rim is exceptionally stable. As shown in the drawings, tabs 40 are formed each with a reduced neck portion 41 which is substantially the same width, preferably a little less than the 7¾% in. shown in FIG. 2 as the width of slots 42, and also are formed with shoulders 43 for preventing floor 22 from lifting off of the underlying spacer means 24. In assembling the floor and spacer means, shoulders 43 are somewhat deformed as they are pushed thru slots 42 but they recover most of their shape to provide thereby the necessary stop mechanism.

Figure 3:
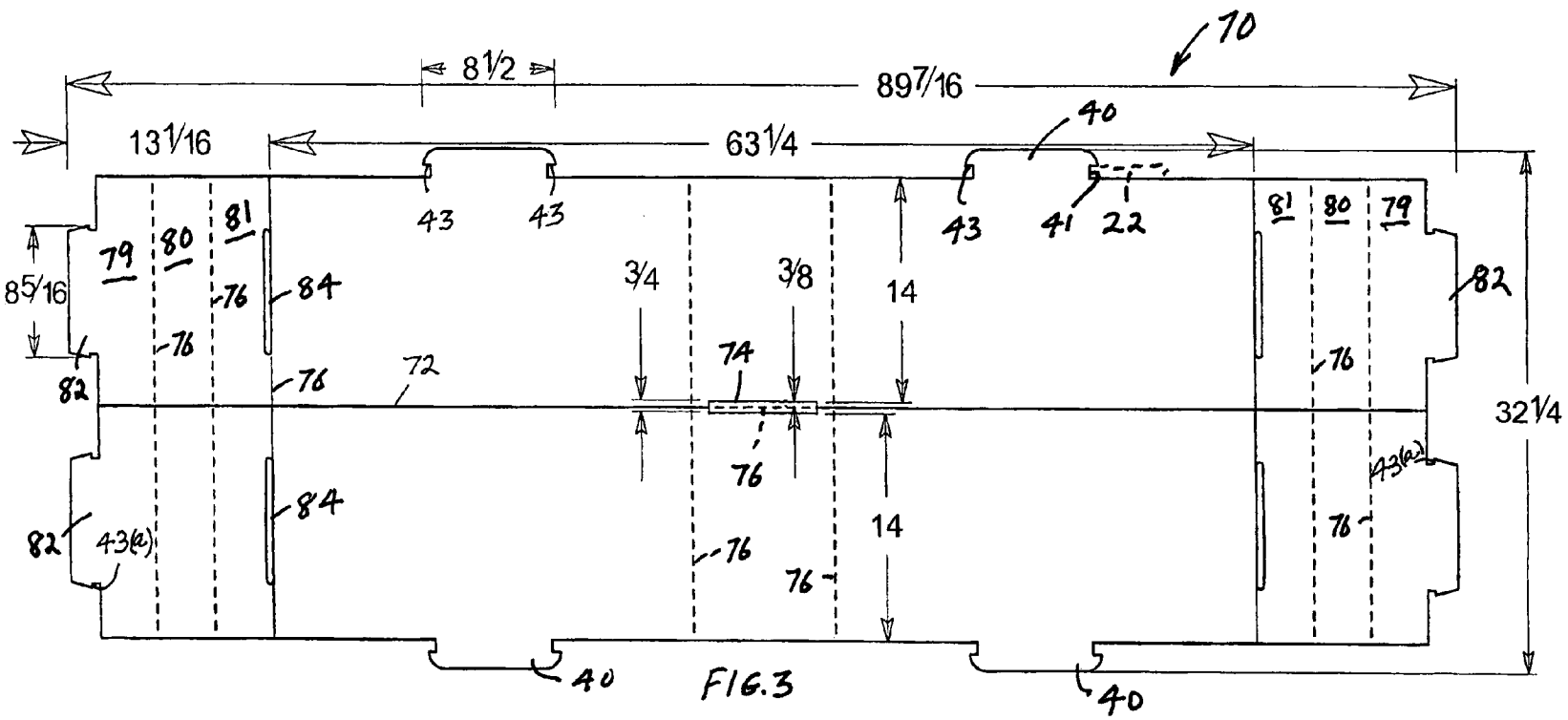
FIG. 3 is a plan view of a spacer means blank of corrugated board with dimension examples.
Figure 5:
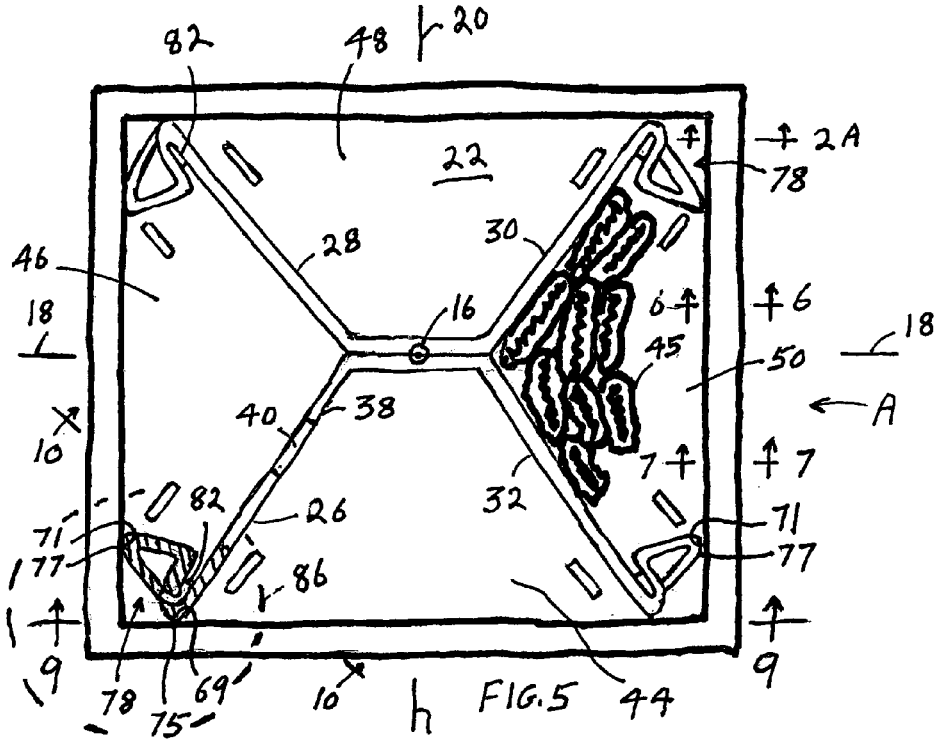
FIG. 5 is a plan view, partially sectioned for clarity, of the top most pallet in FIG. 1 with the top cap (inverted floor) removed.
Figure 6:
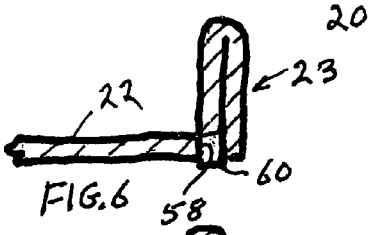
FIG. 6 is a cross-section taken along line 6-6 in FIG. 5.

The spacer means 24 is formed preferably from a corrugated board blank 70 (FIG. 3) preferably a weight of from about 2-4 oz./ft$^2$, which is folded along cut line 72 and fold line 76, and the arms 26, 28, 30, 32 spread apart from the ends of uncut connector section 74 into the configuration shown in FIG. 5. The triangular cross-sectional shaped end portions generally designated 78 of the support arms are formed by folding sections 79, 80 and 81 about fold lines 76 and inserting lock tabs 82 thru slots 84 as shown in FIG. 5 in the encircled dotted cross-sectioned area 86. These triangular end portions serve an important function in that their apicies 75 and 77 are adapted to forcibly engage shoulder portions 69 and 71 respectively formed by the inner surfaces of rim 23 at its corners, when the assembly experiences twisting forces about its axis 16. This engagement prevents, or at least markedly diminishes damage to the assembly and the frangible items contained therein. Tabs 82 are also provided with shoulders 43(*a*) which are equivalents to shoulders 43. This construction allows the assembly of the spacer means within the peripheral floor rim to proceed smoothly.

Figure 4B:
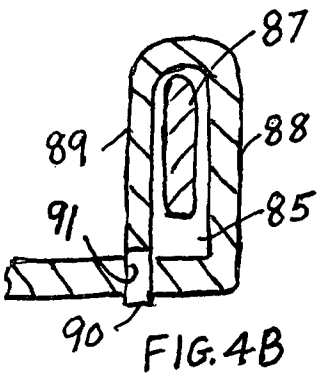
FIG. 4B is a cross-sectional view taken along line 4B-4B in FIG. 4A.
Figure 4:
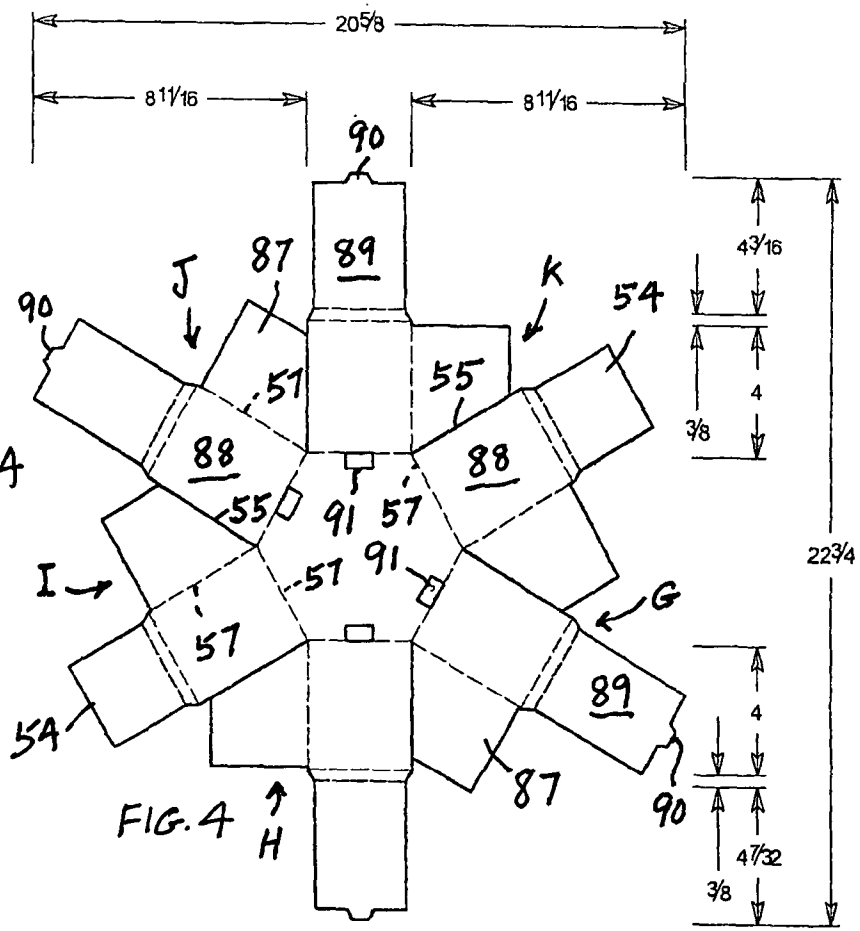
FIG. 4 is a plan view of a foot member blank of corrugated board with dimension examples.
Figure 4A:
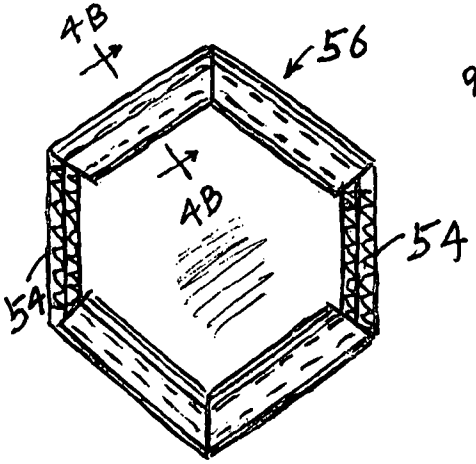
FIG. 4A is a top view of a folded up blank of FIG. 4 ready for attachment to the bottom floor of a pallet stack.
Figure 10:
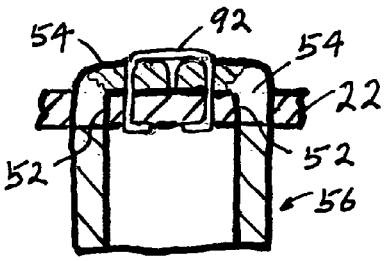
FIG. 10 is an enlarged thickness cross-sectional view taken along line 10-10 in FIG. 5 and showing the attachment of a foot member to the bottom floor of a pallet stack.
Figure 9:
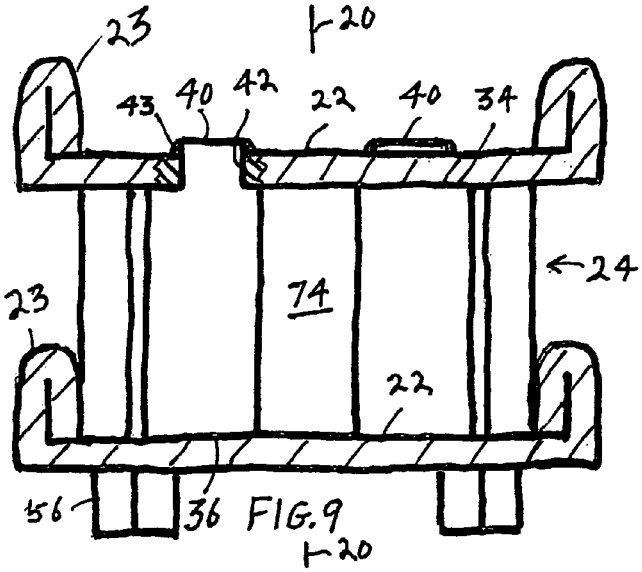
FIG. 9 is a cross-sectional view (enlarged corrugated board thickness) of two lower adjacent pallets taken along line 9-9 in FIG. 5, with portions broken away for clarity.

Referring to FIGS. 4, 4A and 4B, the foot members 56, where used, are formed from a single blank 53 which is cut along solid lines such as 55 and folded along dotted lines such as 57 to give the polygonal, preferably, hexagonal endwise configuration of FIG. 4A. In this structure, an example of the sequence folding each segment G, H, I, J, K is to fold each section 87 in turn upwardly to a right angle from the plane of the drawing, then fold each section 88 upwardly to a right angle from said plane, and then fold each section 89 downwardly toward the floor and insert each lock tab 90 thru its slot 91. Sections 87 of adjacent segments will be captured in each cavity 85 formed by folding 89 to its downward position for locking. The large tabs 54 are used as shown in FIG. 10 for insertion thru slots 52 in the floor and then stapled or the like as at 92 to the floor. Any number of foot members may be employed, including a central one positioned generally on the vertical axis.

The invention has been described in detail with particular reference to preferred embodiments thereof, but it will be understood that variations and modifications will be effected with the spirit and scope of the invention.

I claim:

1. A pallet type of shipping and display assembly for containing frangible, lightweight packaged food comprising an upright stack of pallets having a vertical axis, each pallet having a rectangular floor formed with a peripheral upstanding rectangular rim having a shoulder on its inner surface, wherein said floor is comprised of rectangular sheet material, each said pallet further having a spacer nested on said floor within the confines of said rim and having a radially extending array of spacer arms having end portions engaging said shoulder to prevent angular movement about said axis between said floor and said spacer to thereby retain the configuration integrity of said assembly resisting twisting torque during transport or handling of the loaded assembly, locking tabs on upper edge portions of said spacer and inserted thru slots in an adjacent floor of an upper pallet to prevent angular movement about said axis between said spacer and said adjacent floor, whereby the combination of said tabs, slots, arm end portions and rim provides a pallet assembly having resistance to twisting deformation, wherein said spacer has a height to space said pallets vertically sufficiently to contain packages of said items on the pallet floors and to display said items to the viewing public, wherein each spacer and an upper floor attached thereto are readily disassembled from the stack by lifting said spacer out of the associated rim, wherein each said spacer is of uniform height, wherein said end portions of each said spacer arm are formed into a polygon in lateral cross-section, wherein said polygon is triangular in lateral cross-section, wherein an apex of each said polygon is contiguous to each a side portion of said rim which lies adjacent to a different corner of said rim, wherein each of said floors and each said spacer is formed from a blank of corrugated board, and wherein the bottom floor of said stack is provided with downwardly extending foot members adjacent each corner of said floors, wherein each said foot member is formed from a blank of corrugated board which is formed into a generally polygonal lateral cross-section, and wherein each said foot member is fastened to said bottom floor by means of tabs which extend upwardly from each said foot member and up through said bottom floor and which are bent over onto an upper surface of said bottom floor and secured to said bottom floor.

2. The structure of claim 1 wherein four of said spacer arms are used and are interconnected by a straight connector section of the spacer blank, wherein said connector section is substantially longitudinally aligned with a longitudinal axis of said floor, and wherein each spacer arm is angled laterally from an end of said connector section toward a different corner of said floor.

3. The structure of claim 2 wherein the top spacer of said stack is capped by an inverted one of said floors.

4. The structure of claim 3 wherein said spacer is formed by folding a corrugated board blank on its longitudinal axis wherein the fold line runs longitudinally thru said connector section.

5. The structure of claim 1 wherein a fifth foot member is affixed to said bottom floor at the center thereof.

6. A shipping and display pallet assembly of corrugated board containing bags of frangible, lightweight food items, said assembly comprising an upright stack of pallets having a vertical axis, each pallet having a rectangular floor formed with a peripheral upstanding rim having four corners and having a shoulder on its inner surface, each said pallet further having a spacer nested on said floor within the confines of said rim and having a radially extending array of spacer arms with end portions engaging said shoulder and preventing angular movement about said axis between said floor and said spacer, locking tabs on upper edge portions of said spacer and inserted thru slots in an adjacent floor of an upper pallet preventing angular movement about said axis between said spacer and said adjacent floor, adjacent floor; the combination of said tabs, slots, arm end portions and rim provides a pallet assembly having resistance to twisting deformation and retaining the configuration integrity of said assembly resisting twisting torque during transport or handling of the loaded assembly, said spacer having a height sufficient to space said pallets vertically to contain packages of said items on the pallet floors and to display said items to the viewing public, wherein each said spacer is of uniform height, wherein said radially outer end portions of each said spacer arm are formed into a generally polygonal configuration in lateral cross-section, and wherein each of said floors and each of said spacers is formed from a blank of corrugated board, wherein the bottom floor of said stack is provided with a downwardly extending foot member adjacent each corner of said bottom floor, wherein each said foot member is formed from a blank of corrugated board which is formed into a polygonal lateral cross-section, and wherein each said foot member is fastened to said bottom floor by means of tabs which extend upwardly from each said foot member and up through said bottom floor and which are bent over onto an upper surface of said bottom floor and secured to said bottom floor.

7. The assembly of claim 6 wherein each said generally polygonal configuration of said end portions of the spacer arms forms a triangle in lateral cross-section.

8. The structure of claim 7 wherein an apex of each said triangle is contiguous to each side portion of said rim which lies adjacent to a different corner of said rim.

9. The structure of claim 6 wherein four of said spacer arms are used and are interconnected by a straight connector section of the spacer blank, wherein said connector section is substantially longitudinally aligned with a longitudinal axis of said floor, and wherein each said spacer arm is angled laterally from an end of said connector section toward a different corner of said rim.

* * * * *